US006149091A

United States Patent [19]

Poloni et al.

[11] Patent Number: 6,149,091

[45] **Date of Patent: *Nov. 21, 2000**

[54] COILING METHOD AND RELATIVE DEVICE

[75] Inventors: Alfredo Poloni, Fogliano Redipuglia; Andrea De Luca, Remanzacco, both of Italy

[73] Assignee: Danieli & C. Officine Meccaniche SpA, Buttrio, Italy

[ * ] Notice: This patent issued on a continued prosecution application filed under 37 CFR 1.53(d), and is subject to the twenty year patent term provisions of 35 U.S.C. 154(a)(2).

[21] Appl. No.: 08/882,494

[22] Filed: Jun. 25, 1997

[30] Foreign Application Priority Data

Jun. 26, 1996 [IT] Italy ..... UD96A0111
Jun. 26, 1996 [IT] Italy ..... UD96A0112

[51] Int. Cl.[7] ..... B21C 47/10; B21F 3/00

[52] U.S. Cl. ..... 242/361.4; 242/361.5; 242/362; 140/124

[58] Field of Search ..... 242/361.4, 361.5, 242/362; 140/124

[56] References Cited

U.S. PATENT DOCUMENTS

| | | | |
|---|---|---|---|
| 3,111,286 | 11/1963 | Lorenz | 242/361.4 |
| 3,675,865 | 7/1972 | Eschenbach | 242/361.4 |
| 3,703,261 | 11/1972 | Cofer et al. | 242/361.4 |
| 3,822,045 | 7/1974 | Johnson | 242/362 |

FOREIGN PATENT DOCUMENTS

| | | |
|---|---|---|
| 0566910 | 10/1993 | European Pat. Off. . |
| 994543 | 11/1951 | France . |
| 1425167 | 4/1966 | France . |
| 2015046 | 10/1971 | Germany . |
| 2418184 | 11/1975 | Germany . |
| 759575 | 10/1956 | United Kingdom . |
| 9244409 | 4/1963 | United Kingdom . |
| 1225420 | 3/1971 | United Kingdom . |

*Primary Examiner*—John Q. Nguyen
*Attorney, Agent, or Firm*—Antonelli, Terry, Stout & Kraus, LLP

[57] ABSTRACT

Method to coil metal wire made of steel arriving directly from an in-line rolling plant, in which the metal wire is delivered to a rotating loop-forming head (11) cooperating coaxially with a hollow drum (12) to form the coil (13), the hollow drum (12) having a controlled rotary movement, the relative speed of the loop-forming head (11) and the drum (12) together being functional to the layer being formed, the drum (12) being associated with an alternate axial moving system. Device to coil metal wire made of steel arriving directly from an in-line rolling plant, comprising a rotating loop-forming head (11) associated with a mating pinch roll device (15) to feed the wire being coiled, and cooperating coaxially with a drum (12) to form the coils (13), the drum (12) being associated both with means to supply a controlled rotary movement and also with an alternate axial moving system (14), the rotation of the loop-forming head (11) and/or drum (12) being a function of the coiling step and the speed of feed of the wire being coiled.

19 Claims, 3 Drawing Sheets

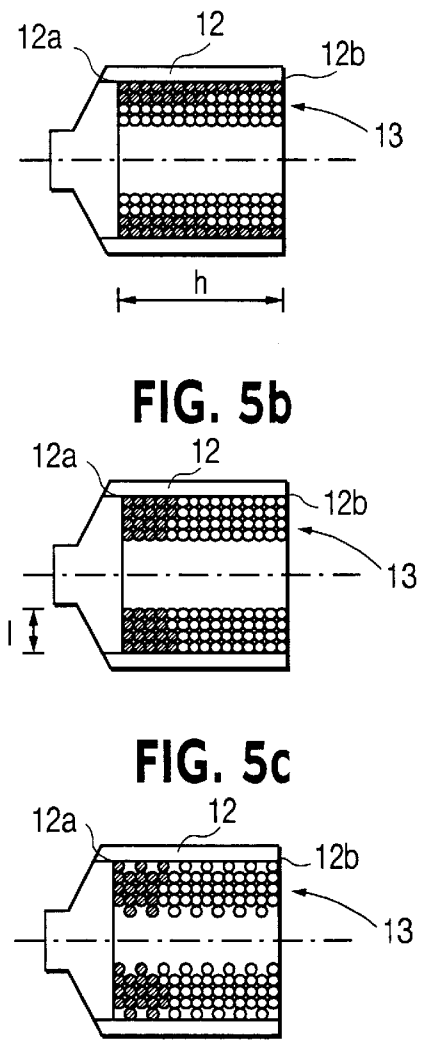
FIG. 5a
FIG. 5b
FIG. 5c
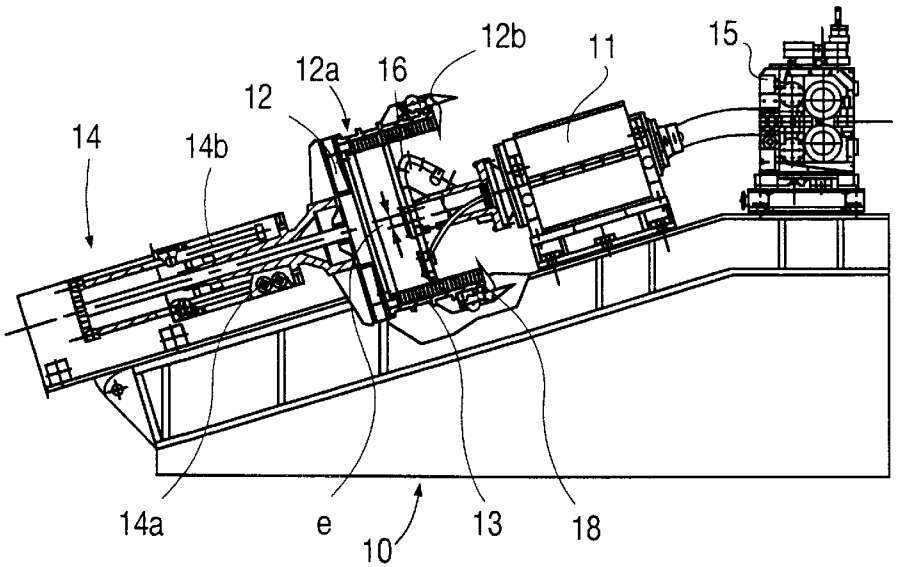
FIG. 4
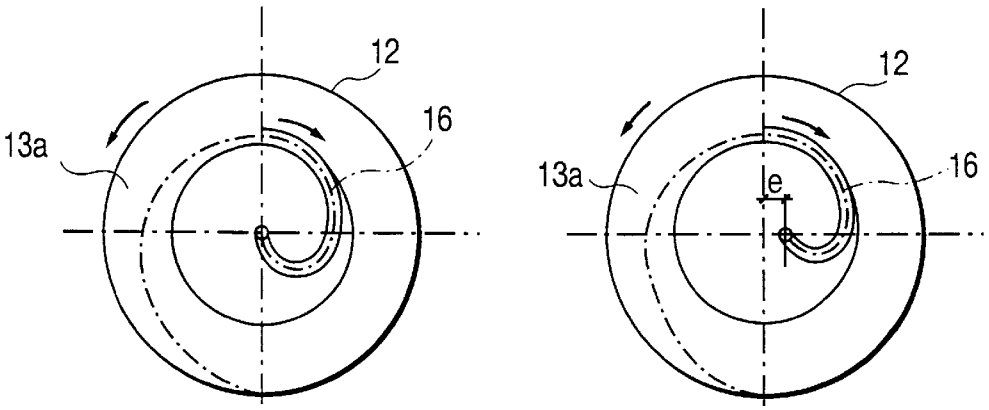
FIG. 6a
FIG. 6b

COILING METHOD AND RELATIVE DEVICE

BACKGROUND OF THE INVENTION

This invention concerns a method to coil metal wire and the relative device.

The invention is applied in the field of steel production, to coil semi-worked products arriving directly from hot or cold rolling plants, such as wire, wire rods, round pieces or the like, made of steel.

The state of the art covers various methods to coil semi-worked products from the rolling plant.

According to one method, a loop-forming head is combined with a roller way system and a coil forming pit where the loops, produced by the head and made to fall progressively onto the roller system, are discharged into the coil forming pit, and superimpose themselves around a core and form the coil.

This method, although it is very commonly used, has many disadvantages in terms of the cost and bulk of the machinery, and also in terms of the stability, density and bulk of the coils themselves.

The coils formed according to this method have a low density coefficient of the loops, which is given by the ratio between the effective volume of the loops and the total bulk volume of the coil; in this case it is at most 0.15.

GB-A-924.409 teaches to prepare coils of copper wire by making a stationary container cooperate with a rotary loop-forming head which is movable axially.

The coils are deposited gradually on successive levels by force of thrust and are deposited stationary, so it is only the force of thrust generated by a drawing assembly which gives the coils the strength to maintain the position in which they are deposited.

U.S. Pat. No. 3,111,286 includes a loop-forming head which diverts the steel round piece by 90° and more before delivering it to the loop-forming head proper.

The diversion by itself creates considerable problems, which are further aggravated by the fact that for many years now the rolled product has been able to travel at 100 meters per second and more.

Moreover, the diversion creates particular problems when thin rolled products are being used.

The loop-forming head cooperates with a rotary drum wherein the loops drop by their own weight as they form.

The loops, which fall due to the force of gravity, are deposited where and as they fall, without any control, and this does not ensure a satisfactory coefficient of density.

FR-A-1.425.167 includes a stationary vase or container inside which a loop-forming head cooperates; the reciprocal positions of the vase and the loop-forming head can be axially modified.

A drawing device gives the metallic wire the thrust to rest the loops under pressure on the wall of the vase or container.

Due to the force of thrust, the loop-forming head rotates, and the rotation can be adjusted with friction-generating means in order to control the resistance to rotation and therefore the thrust which can be exerted by the loops against the container.

The present applicant, who for many years now has been pressed by clients to provide a system suitable to obtain precision coils with a high coefficient of density, understood that the state of the art did not deal with the problem in the correct terms.

The applicant understood that when a loop-forming head cooperates with a stationary container, the loops formed by the head do not rotate with respect to the axis of the coil.

Consequently the loops leaving the loop-forming head tend to expand (widen) only due to the elastic reaction of deformation undergone by the rolled product as it passes from straight to circular.

The entity of this elastic force, which tends to widen the loops, depends on the characteristics of the rolled material and its physical condition; it depends for example on the temperature, which is around 700–800° C.

For thin rolled products made of steel which have the normal, end-of-rolling temperature, the elastic reaction may be particularly low and insufficient to hold the loops stationary on the coil.

SUMMARY OF THE INVENTION

The present applicant has designed, tested and embodied this invention to overcome the shortcomings of the state of the art and to achieve further advantages.

The purpose of the invention is to achieve a method to coil wire, and the relative device, which will allow the rapid formation of stable coils, of limited bulk, with a high filling coefficient, not subject to deforming stresses and where the loops do not become slack and/or fall.

A further purpose of the invention is to achieve a method which allows the rolled product to be coiled as it arrives from a rolling mill in a continuous cycle and which uses simple devices which are not bulky and are not expensive to achieve.

Furthermore, it is the purpose of the invention to be able to obtain the above coils with rolled products which are travelling at present-day rolling speeds which may reach 130 meters per second and more.

The device according to the invention is essentially composed of a rotating loop-forming head which cooperates with a hollow drum to contain the reel of coiled wire.

According to the invention, during the coiling step, the drum is made to rotate with respect to the loop-forming head.

The rotary movement of the drum generates centrifugal radial forces of a value which can be programmed, and which are added to the elastic reaction in compressing the loops against the wall of the container, in such a way that the loops are prevented from slackening and therefore from falling; the loops however are not subjected to damaging deforming stresses, on the contrary, their stability is further ensured.

The drum, or container, and the loop-forming head have a reciprocal axial position which can be varied in a programmed manner.

According to a variant, the loop-forming head during the coiling step, is progressively positioned inside the drum for the whole height thereof.

In this way, the loops fed by the loop-forming head are deposited in a controlled manner directly on the wall of the drum, or container, or on the layer of already-formed loops, always maintaining the smallest distance possible between the outlet of the loop and the surface on which it is deposited.

This guarantees the greatest accuracy and a rigorous control of the loops as they are deposited in every step of the coil forming operation.

According to a variant, the drum, or container, is mounted on a sliding element which allows it to be moved in an alternate axial way, during the progressive formation of the coil, and permitting the uniform distribution of the loops by the loop-forming head.

According to one embodiment of the invention, the drum, or container, is arranged with its axis substantially aligned with the axis of feed of the rolled product and substantially coaxial to the axis of the loop-forming head.

According to a variant, in order to obtain a coil where the rings of the loops are progressively staggered, the loop-forming head and the drum are arranged inclined at a reduced angle, up to a maximum value of about 20°, with respect to the axis of feed of the rolled product.

According to a further embodiment, the axis of the container and the axis of the loop-forming head are eccentric, substantially parallel but not coincident.

According to a variant of the invention, in order to prevent the loops from being superimposed when the sliding element reverses its movement, the latter is mounted on a second supplementary sliding element which can be moved in the opposite direction.

The speeds of the two sliding elements are modulated in such a way that the sum of the speeds determines an alternate movement of the drum, or container, at a desired constant speed, allowing the loops to be distributed in an extremely uniform way inside the drum itself.

For the applicant has discovered that, in order to avoid unwanted superimpositions, the inversion of the movement of the drum must take place in an extremely brief time, (about 0.05"), during which time the system generates on average two loops.

In this brief lapse of time, a conventional system, either hydraulic or mechanical, would not be able to reduce the axial speed of the drum from its maximum value to a zero value and then increase it again to its maximum value in the opposite direction.

According to a variant of the invention, the speed of rotation of the loop-forming head is modulated during the coiling step, in order to control and instantly regulate the diameter of the loop and therefore to obtain the formation of a coil of optimum quality.

The regulation and control of the diameter of the loop, according to the invention, are based on the fact that, if the tangential speed of the loop-forming head is less than the speed of feed of the wire being coiled, the loops produced have a greater diameter than the outlet diameter of the head which produces them.

Therefore, starting from an initial speed of rotation of the loop-forming head which is less than the speed-at which the loops leave the head, and increasing this speed in coordination with the step the coil has reached in its formation, the diameter of the loops will be progressively less and less, and according to the layer of coiling in progress.

The coils which are formed are not subjected in this way to deforming stresses caused by their being adapted to a lesser diameter, and can thus be distributed more uniformly inside the drum itself.

In this way the loops are made more compact and the coil is filled more efficiently, with a coefficient which is in any case greater than 0.5, and there is also less risk of a change in the geometry of the material.

According to a variant of the invention, the increase in the relative speed, as coiling proceeds, of the loop-forming head and the drum, is obtained by progressively increasing the speed of rotation of the drum, and keeping the speed of the loop-forming head constant.

According to a variant, the drum is made to rotate counter to the loop-forming head.

According to another variant, both the speed of the loop-forming head and the speed of the drum are progressively increased, according to a correlated value, in order to increase the relative speed with respect to the speed of feed of the wire.

According to another variant, only the speed of rotation of the loop-forming head is increased, in such a way that the diameters of the loops are progressively smaller with each pass, and the desired thickness of the reel of wound wire is obtained.

By using two coiling devices according to the invention, fed alternately and in a coordinated manner, it is possible to produce coils continuously, without having to interrupt the cycle in order to discharge the reels of coiled wire.

According to one embodiment of the invention, the finished coil can be rotated on a vertical axis so as to be extracted from the drum-container.

It is possible to remove the reels of coiled wire from the containing drum by means of extremely simple devices, for example by means of a fork element or an articulated arm, able to extract the reel and deposit it on the discharge means.

All the components of the coiling station are therefore easily achieved and not expensive, and do not take up much space.

BRIEF DESCRIPTION OF THE DRAWINGS

The attached figures are given as a non-restrictive example and show a preferred embodiment of the invention as follows:

FIG. 4 shows a variant of FIG. 3*a;*

FIGS. 5*a,* 5*b* and 5*c* show three possible embodiments for coiling according to the invention;

FIGS. 6*a* and 6*b* show two diagrams for coiling according to the invention in which the axis of the drum and the axis of the loop-forming head are respectively parallel and coincident, and parallel and not coincident.

DETAILED DESCRIPTION OF THE PREFERRED EMBODIMENTS

The coiling device 10 is used to produce coils 13 of wire, round pieces or wire rods arriving directly from the rolling train.

Figure 1:
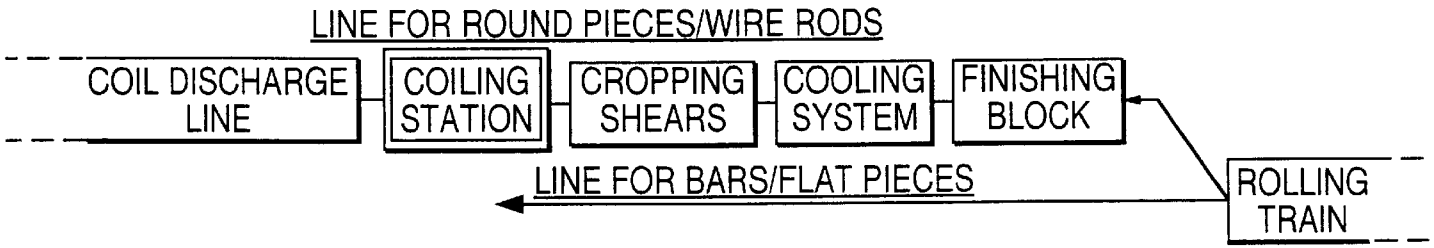
FIG. 1 is a diagram of a rolling line comprising a coiling station.
Figure 2:
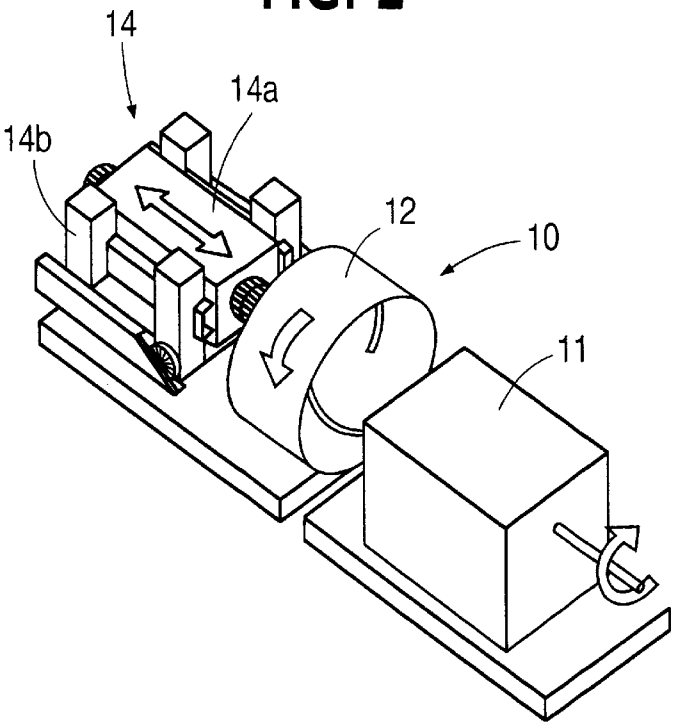
FIG. 2 is a three-dimensional diagram of the coiling device according to the invention.

In this case, the coiling device 10 is placed immediately downstream of the cropping shears as shown in FIG. 1.

The coiling device 10 according to the invention comprises a rotating loop-forming head 11, of a structure substantially known, cooperating with a hollow drum 12 horizontal in development and containing the reel 13*a* of coiled wire.

The loop-forming head 11 has a guide conduit 16.

The drum 12 is mounted on a moving system 14 which moves the drum in an alternate axial manner.

Figure 3A:
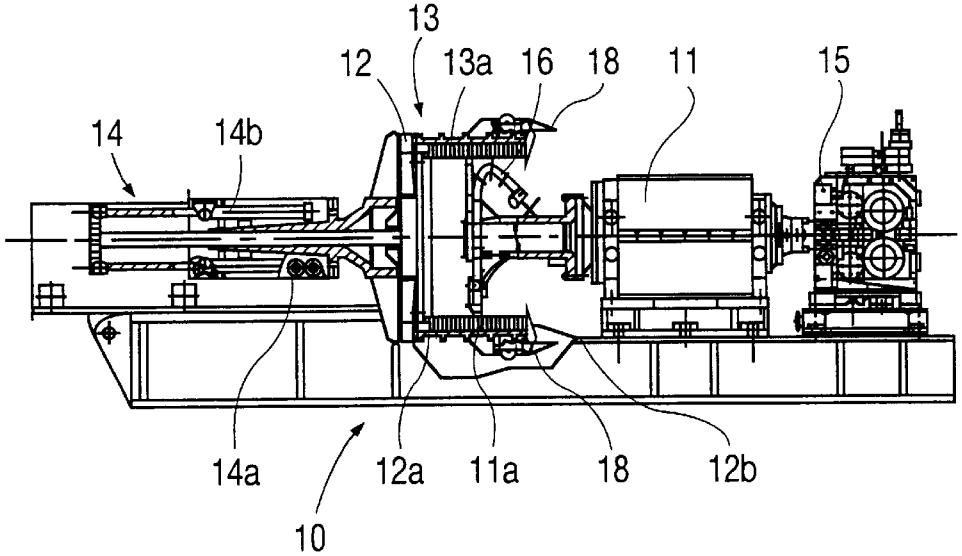
FIG. 3*a* shows a longitudinal section of the coiling device according to the invention during the coiling step.
Figure 3B:
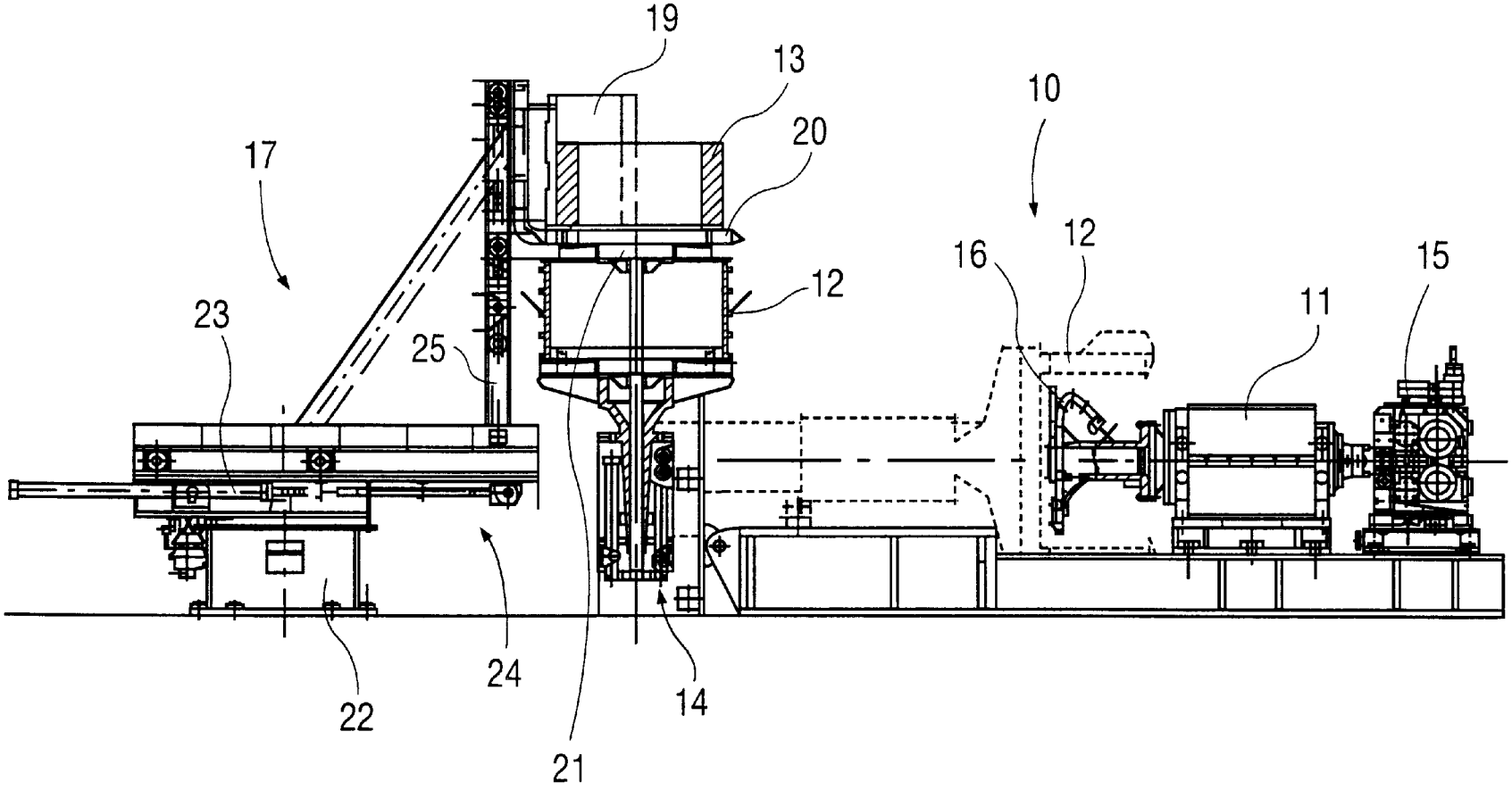
FIG. 3*b* shows the extraction and discharge of the completed coil.

According to the variant shown in FIG. 3*b,* the moving system 14 enables the drum 12 to be rotated vertically, in this case by 90°, during the extraction and discharge of the completed reel 13*a*.

The moving system 14 rotates the drum 12 around its longitudinal axis, in the same direction as, or the opposite direction to, the rotation of the loop-forming head 11.

This rotary movement of the drum 12 generates contrasting radial forces able to prevent the reel 13 from slackening and/or the loops from falling, without however causing unwanted plastic deformations on the loops themselves.

Upstream of the coiling device 10 there is a pinch roll device 15 which feeds the wire to be coiled to the loop-forming head 11.

There is also a device 17, shown diagrammatically in FIG. 3*b,* to extract the reels 13 of completed coils.

During the coiling step, the drum 12 is taken, by the moving system 14, to a position mating with the loop-forming head 11 in such a way that the outlet mouth 11*a* of the head 11 is inside the drum 12, advantageously at an end position.

According to one embodiment of the invention which achieves the method to distribute the loops as shown in FIG. 5*a,* the drum 12 is moved with a continuous and alternate axial movement in such a way that the outlet mouth 11*a* of the loop-forming head 11 is always placed in a position inside the drum 12, from one end point 12*a* to the other end point 12*b* of the working depth, or height, of the drum and vice versa.

Each cycle of movement of the drum 12 therefore comprises a to-and-fro movement.

In the course of each of these two steps the loop-forming head 11 gradually deposits a series of loops occupying the whole depth, or height, of the drum 12, the loops being distributed one on top of the other in layers along the height "h" of the drum 12.

In the following step, the loops are deposited in the opposite direction and inside the loops already deposited during the preceding step.

In this particular case, in order to obtain a uniform distribution of the loops while maintaining in each step the outlet position of the loops as close as possible to the relative surface on which they are deposited, and to prevent them from being superimposed one on top of the other inside the drum 12, the drum 12 is associated with a moving system 14 composed of two sliding elements, of which the first 14*a* is mounted on the second 14*b*.

According to the invention, the two sliding elements 14*a* 14*b,* move in opposite directions and at such a speed that the sum of their speeds always gives a substantially constant axial speed of the drum 12.

The accelerations/decelerations of the first sliding element 14*a* during the reversals of movement are compensated for by the second sliding element 14*b* and vice versa, which allows the alternate axial movement of the drum 12 at a constant desired speed for the entire coiling step, the speed being correlated to the speed at which the loops leave the loop-forming head 11.

In order to limit the reel 13*a* of coiled wire inside the depth of the drum 12, and therefore to prevent the loops from coming out, there are containing means 18 which close during coiling and open when the coil is extracted.

According to the method of distribution as shown in FIG. 5*b,* the loops are deposited in spiral-shaped layers lying one next to the other progressively more inside on the width "l" of the coil.

According to the method of distribution as shown in FIG. 5*c,* the layers of loops are deposited progressively staggered in such a way that they are arranged substantially in a petal shape.

This distribution is obtained advantageously by arranging the loop-forming head 11 and the drum 12 inclined at a certain angle, for example between 10° and 20°, with respect to the direction of feed of the rolled product (FIG. 4), and by achieving a desired eccentricity "e" between the axis of the loop-forming head 11 and the axis of the drum 12.

The formation of a petal-shaped coil brings substantial advantages in that the reel is compact, and also it is possible to descale the product efficiently. Moreover, the bigger spaces between the layers of loops assist the cooling of the wound product, and in a controlled manner.

According to the invention, the relative speed of the loop-forming head 11 and the drum 12 is modulated during coiling in order to control the diameter of the loops produced, allowing a more compact distribution of the loops inside the drum 12 and a reduced risk of permanent deformations in the material.

In a first embodiment, the speed of rotation of the loop-forming head 11 is progressively increased while the speed of the drum is maintained constant, in coordination with the coiling rate, from an initial value less than the speed of feed of the wire, which determines the formation of loops of an always decreasing diameter, said diameter mating with the layer which is always further inside the reel 13*a* of the coiled wire being formed (see FIGS. 6*a* and 6*b*).

According to a first variant, the speed of the loop-forming head 11 is maintained substantially constant, while the speed of counter-rotation of the drum 12 is progressively increased.

According to another variant, both the speed of the loop-forming head 11 and that of the drum 12 are regulated in a correlated way during the coiling step in order to obtain the desired progressive increase as the inner layers of the reel 13*a* of coiled wire are formed.

When the loops are deposited as shown in FIG. 5*a,* the speed of the loop-forming head 11 is gradually increased at the end of every pass and thus with every formation of the outer layer of the coil in the direction of the height "h" of the coil 12.

When the loops are deposited as shown in FIG. 5*b,* the speed of the loop-forming head 11 is progressively increased for every layer deposited along the width "l" of the coil, and is then cyclically slowed down again so as to form the adjacent layer.

A station comprising two coiling devices 10 alternately fed by two pinch roll devices 15 with the product arriving from the cropping shears, can operate continuously without interruptions needed to discharge the reels 13*a*.

The cropping shears can also function as a switching device to direct the wire to be coiled alternately to one or the other of the devices 10.

The reels 13*a* can be removed by means of the device 17 as shown in FIG. 3*b,* comprising an extraction plane 21 which lifts the reel 13 outside the drum 12, and a rotary support 22 with a trolley 24 movable by jack means 23.

The movable trolley 24 includes vertical guide means 25 on which a fork system 20 can slide, the fork system 20 being suitable to lift the reel 13*a* from the extraction plane 21, and means 19 for the lateral control of the coil 13.

The device 17 is able to extract the reels 13*a* when they have been completed and deposit them, by means of the rotation of the rotary support 22 and the lowering of the fork system 20, onto a discharge system composed of, for example, a pinch roll device.

The coiling method according to the invention and the relative device 10, which is extremely simple and compact, therefore allow the formation of coils 13 of the very highest quality, stable, with a high filling coefficient and without causing any deformation of the coiled product.

What is claimed is:

1. Method to coil metal wire made of steel arriving directly from a high-speed in-line rolling plant, comprising delivering the metal wire from the high-speed in-line rolling plant along a substantially horizontal axis to a loop-forming head cooperating with a hollow drum, coiling the wire by rotating the loop-forming head at a first speed and rotating the hollow drum at a second speed to form the coil, wherein an axis of rotation of the loop-forming head and an axis of rotation of the hollow drum are not substantially vertical, the relative rotation speed of the loop-forming head and the drum together being a function of the layer being formed, and axially moving the hollow drum with respect to the loop-forming head during formation of the coil.

2. Method as in claim 1, comprising, during coiling, progressively increasing the first speed of the loop-forming head at least layer by layer.

3. Method as in claim 1, comprising, during coiling, progressively increasing the second speed of the drum at least layer by layer.

4. Method as in claim 1, comprising during coiling, varying both the first speed of the loop-forming head and the second speed of the drum to obtain a progressive total increase in the relative speed of the loop-forming head and the drum together.

5. Method as in claim 1, wherein during coiling, the drum is continuously moved axially and alternately, the axial movement being a function of the diameter of the wire.

6. Method as in claim 5, wherein the drum is moved axially by an alternate axial moving system which comprises first and second sliding elements and the method comprises moving the first and second axial sliding elements in opposite directions to each other, and varying a speed of the first sliding element in one direction as a function of a variation in speed of the second sliding element in the other direction.

7. Method as in claim 1, wherein, during coiling, the drum is axially moved from a first position wherein loop-forming head cooperates with a first end point of the drum, to a second position wherein the loop-forming head cooperates with a second end point of the drum.

8. Method as in claim 1, wherein coiling is carried out while maintaining the loop-forming head and the drum inclined at an angle with respect to the direction of feed of the metal wire up to a maximum of 20°.

9. Coiling device for metal wire made of steel arriving directly from an in-line rolling plant along a substantially horizontal axis, comprising a rotating loop-forming head, an axis of rotation of the loop-forming head not being substantially vertical; a mating pinch roll device to feed the wire to be coiled to the rotating loop-forming head; a drum in which coils formed by the loop-forming head are deposited, an axis of rotation of the drum not being substantially vertical; means to supply a controlled rotary movement to the drum; and an axial moving system for axially moving the drum with respect to the loop-forming head during formation of the coil, the rotation of the loop-forming head and of the drum being a function of the coiling step and of the speed of feed of the wire to be coiled.

10. Device as in claim 9, wherein the axial moving system of the drum comprises first sliding elements solidly associated with the drum and mounted on second sliding elements, the second sliding elements being able to move in the opposite direction to that of the first sliding elements, the variations in speed of one or another of the sliding elements being functionally correlated.

11. Device as in claim 9, wherein the drum has a first lengthwise position where the loop-forming head cooperates with a first end point within the drum and a second lengthwise position where the loop-forming head cooperates with a second end point within the drum the drum being displaced alternately, during the coiling step, from the first to the second position at a speed which is correlated to the speed at which the loops leave the loop-forming head.

12. Device as in claim 9, further comprising containing means to limit a maximum lengthwise position of the reel of coiled wire, the containing means being positioned in proximity of an outer periphery of the drum and having a first closed position during the coiling step and a second open position when the reel is discharged.

13. Device as in claim 9, wherein the axis of the drum and the axis of rotation of the loop-forming head are coaxial.

14. Device as in claim 9, wherein the axis of the drum and the axis of rotation of the loop-forming head are not aligned.

15. Device as in claim 9, wherein the drum rotates in the same direction as the loop-forming head.

16. Device as in claim 9, wherein the drum rotates in the opposite direction to the loop-forming head.

17. Device as in claim 9, wherein the axis of the device is coaxial with the axis of the metal wire arriving from the in-line rolling plant.

18. Device as in claim 9, wherein the axis of the device is inclined at an angle with respect to the axis of the metal wire arriving from the in-line rolling plant up to a maximum of 20°.

19. Device as in claim 9, wherein the device has a first coiling position and a second position for the extraction of the coil with the axis of the drum substantially vertical.

* * * * *